US009659457B2

(12) United States Patent
Mitelman et al.

(10) Patent No.: US 9,659,457 B2
(45) Date of Patent: May 23, 2017

(54) GAMING MACHINE AND METHOD HAVING PLAYER ELECTABLE BONUS FEATURES

(71) Applicant: Atlas Gaming Technologies Pty. Ltd., Port Melbourne (AU)

(72) Inventors: Boris Mitelman, Port Melbourne (AU); Daniel Julio Montenegro, Port Melbourne (AU); Robert Sloot, Port Melbourne (AU); Alessandro Ciampoli, Port Melbourne (AU); Zenja Solaja, Port Melbourne (AU); Wade Clark, Port Melbourne (AU)

(73) Assignee: Atlas Gaming Technologies Pty Ltd. (AU)

( * ) Notice: Subject to any disclaimer, the term of this patent is extended or adjusted under 35 U.S.C. 154(b) by 0 days.

(21) Appl. No.: 14/245,942

(22) Filed: Apr. 4, 2014

(65) Prior Publication Data

US 2015/0018075 A1 Jan. 15, 2015

(30) Foreign Application Priority Data

Apr. 18, 2013 (AU) ..... 2013901364

(51) Int. Cl.
*G07F 17/34* (2006.01)
*G07F 17/32* (2006.01)

(52) U.S. Cl.
CPC ..... *G07F 17/3267* (2013.01); *G07F 17/3262* (2013.01)

(58) Field of Classification Search
CPC ..... G07F 17/3267
USPC ..... 463/25
See application file for complete search history.

(56) References Cited

U.S. PATENT DOCUMENTS

2002/0025846 A1* 2/2002 Bennett ..... G07F 17/3262 463/20
2003/0222402 A1* 12/2003 Olive ..... 273/292
2004/0053679 A1* 3/2004 Getz ..... G07F 17/32 463/20
2005/0026672 A1* 2/2005 Roukis ..... G07F 17/3267 463/16
2006/0142077 A1* 6/2006 Miles ..... G07F 17/32 463/20
2008/0064481 A1* 3/2008 Jackson ..... G07F 17/34 463/20

(Continued)

*Primary Examiner* — David L Lewis
*Assistant Examiner* — Shauna-Kay Hall
(74) *Attorney, Agent, or Firm* — Lerner, David, Littenberg, Krumholz & Mentlik, LLP

(57) ABSTRACT

A gaming machine includes a player interface and an electronic controller arranged to control play of a game on the player interface. Prior to commencement of a bonus round, the electronic controller is arranged to display on the player interface a range of bonus features. Then in response to receiving via the player interface a player-selected bonus feature, the electronic controller determines a number of bonus games to be awarded to the player in the bonus round. The determination of the number of bonus games is randomized and is equalized so that a return to player percentage is at least equal to a predetermined return to player. The gaming machine is further arranged such that the player selected bonus feature applies to each and every awarded bonus game in the bonus round.

18 Claims, 8 Drawing Sheets

(56) References Cited

U.S. PATENT DOCUMENTS

| | | | | |
|---|---|---|---|---|
| 2009/0176552 | A1* | 7/2009 | Hornik | G07F 17/3244 463/20 |
| 2009/0298573 | A1* | 12/2009 | Bramble | G07F 17/32 463/20 |
| 2011/0105216 | A1* | 5/2011 | Cohen et al. | 463/20 |
| 2011/0230254 | A1* | 9/2011 | Englman | G07F 17/32 463/25 |
| 2012/0214580 | A1* | 8/2012 | Hoffman et al. | 463/27 |

* cited by examiner

GAMING MACHINE AND METHOD HAVING PLAYER ELECTABLE BONUS FEATURES

CROSS-REFERENCE TO RELATED APPLICATIONS

The present Application claims priority from Australian Provisional Patent Application No 2013901364 filed on 18 Apr. 2013, the content of which is incorporated herein by reference.

TECHNICAL FIELD

Described embodiments generally relate to a gaming machine and to an improvement to a game played on such a gaming machine. More particularly, the invention relates to a gaming machine having a player selectable bonus feature and a method of using a gaming machine having a player selectable bonus feature.

BACKGROUND

It is desirable for gaming machine operators (and in fact mandatory in some jurisdictions) to have an average return to player which is independent from the player's selection. This is often done by a player choosing a fixed number of bonus games within a bonus round, and the gaming machine's controller applying one or more adjustments to the game rules to compensate for the different number of free games during the bonus round, therefore equalising the return to player between bonus games. Often a first adjustment is a crude pre-determined adjustment that is known to the player at the time of the player selecting a fixed number of free games. The gaming machine's controller then applies a fine adjustment to the return to player, typically after the reel spin which reveals the multiplier. Gaming machines with player-selectable bonuses are especially popular with players.

One of the most popular implementations of a player choosing a fixed number of bonus games within a bonus round consists of linking the player's selection for the number of bonus games to a range of bonus multipliers, where a choice of a particular multiplier within that range is determined at random for each bonus game (or when an eligible combination occurs during bonus games).

One problem with randomised multipliers is that the visual effect of the multiplier symbol on the spinning reel is lost since the multiplier is not displayed during a spin of the reel. Hence, the visual feedback provided to the player is limited and the anticipation of the multiplied win is compromised.

In other games, fixed multipliers are utilised such that during the free games bonus round, the wild symbol on for instance the second and forth reels change their appearance to show "×3" and "×5" respectively. In such games, the player is able to see the combination of the wild symbol and multiplier spinning by and anticipate the win. However the player is not offered any choice before the bonus round.

In still other games, the player is able to choose the number of free games in the bonus round. Depending on the player's choice, the game controller selects two ranges of available multipliers. The game controller decides which multiplier is applied to every wild symbol once the wild symbol is spun up. The multiplier is revealed after the spin is finished, however the visual effect of the multiplier shown during reel spin is lost.

Any discussion of documents, acts, materials, devices, articles or the like which has been included in the present specification is not to be taken as an admission that any or all of these matters form part of the prior art base or were common general knowledge in the field relevant to the present disclosure as it existed before the priority date of each claim of this application.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

SUMMARY

A gaming machine having a bonus round is provided, the gaming machine comprising: a player interface;

an electronic controller arranged to control play of a game on the player interface; wherein prior to commencement of the bonus round, the electronic controller is arranged to:

display on the player interface a range of bonus features; and in response to receiving via the player interface a player-selected bonus feature, determine a number of bonus games to be awarded to the player in the bonus round;

wherein the determination of the number of bonus games is randomized and is equalized so that a return to player percentage is at least equal to a predetermined return to player; and wherein the gaming machine is further arranged such that the player selected bonus feature applies to each and every awarded bonus game in the bonus round.

In one embodiment, the gaming machine may further comprise a memory storing data corresponding to a plurality of bonus game tables, each bonus game table associated with a bonus feature and each bonus game table presenting a range of data values each corresponding to a different number of bonus games.

The controller may be configured to select from the memory, the bonus game table corresponding to the player selected feature and to further select a data value from within the selected table on a weighted random basis. Optionally the selection of the data value from within the selected table may be weighted such that, statistically, at least one data set is more likely to be selected than another. For example, the data sets may be weighted according to a standard, bell curve, statistical, or a normal distribution curve.

In a further embodiment, each bonus feature may be linked to a maximum number of bonus games ($MAX_{FG}$) and a predetermined number of selections ($S_N$), wherein each selection is associated with a range of possible awarded bonus games. In such an embodiment the number of bonus games associated with each selection may be randomized and equalized so that a return to player percentage is at least equal to a predetermined return to player. The controller may be further arranged to randomly allocate a number of bonus games not exceeding $MAX_{FG}/S_N$ to each of the player selectable items which may comprise:

determining a range of potential bonus games to be allocated, each potential bonus game being a chance event;

assigning a weight to each chance event; and calculating the outcome for the player selectable item using a formula that produces a weighted score accounting for each chance event based on its defined weighting.

In a still further embodiment the gaming machine may comprise a memory storing a plurality of predetermined pathways, wherein each pathway comprises a set of bonus games, the size of the set is equal to $S_N$, and wherein the average of each of the predetermined pathways is equalized so that a return to player percentage is at least equal to a predetermined return to player. In such an embodiment the controller may be configured to randomly select one of the pluralities of predetermined pathways.

In an embodiment, the range of bonus features may be a range of multipliers.

In an embodiment, the controller may be arranged to display on separate screens of the player interface, a range of bonus features and a plurality of player selectable items. In an optional embodiment the controller is arranged to display on the same screen of the player interface, a range of bonus features and subsequently a plurality of player selectable items.

The controller may be arranged to include the step of displaying the outcome of each player selected item.

The controller may be arranged such that weights assigned to chance events may be dependent on the selected multiplier.

A method of gaming using a gaming machine having a controller is provided, the method comprising, prior to initiating play of a bonus round:

displaying on a player interface a range of bonus features;

receiving via the player interface a player-selected bonus feature; and determining a number of bonus games to be awarded in the bonus round; wherein the determination of the number of bonus games to be awarded is randomized and is equalized so that a return to player percentage is at least equal to a predetermined return to player; and wherein the player-selected bonus feature applies to each and every awarded bonus game in the bonus round.

In one embodiment, the method may further comprise storing a plurality of bonus game tables, each bonus game table associated with a bonus feature and each bonus game table presenting a range of data values each corresponding to a different number of bonus games. The method may further comprise selecting a bonus game table corresponding to the player selected feature; and selecting a data value from within the selected table on a weighted random basis.

In a further embodiment, each bonus feature may be linked to a maximum number of bonus games ($MAX_{FG}$) and a predetermined number of selections ($S_N$), wherein each selection is associated with a range of possible awarded bonus games. In such an embodiment the number of bonus games associated with each selection may be randomized and equalized according to a predetermined return to player. In such an embodiment the method may further comprise randomly allocating a number of bonus games not exceeding $MAX_{FG}/S_N$ to each of the player selectable items which may comprise: determining a range of potential bonus games to be allocated, each potential bonus game being a chance event;

assigning a weight to each chance event; and calculating the outcome for the player selectable item using a formula that produces a weighted score accounting for each chance event based on its defined weighting.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF DRAWINGS

In order that the present invention may be more clearly ascertained, embodiments will now be described, by way of example, with reference to the accompanying drawing, in which.

DESCRIPTION OF EMBODIMENTS

Figure 1:
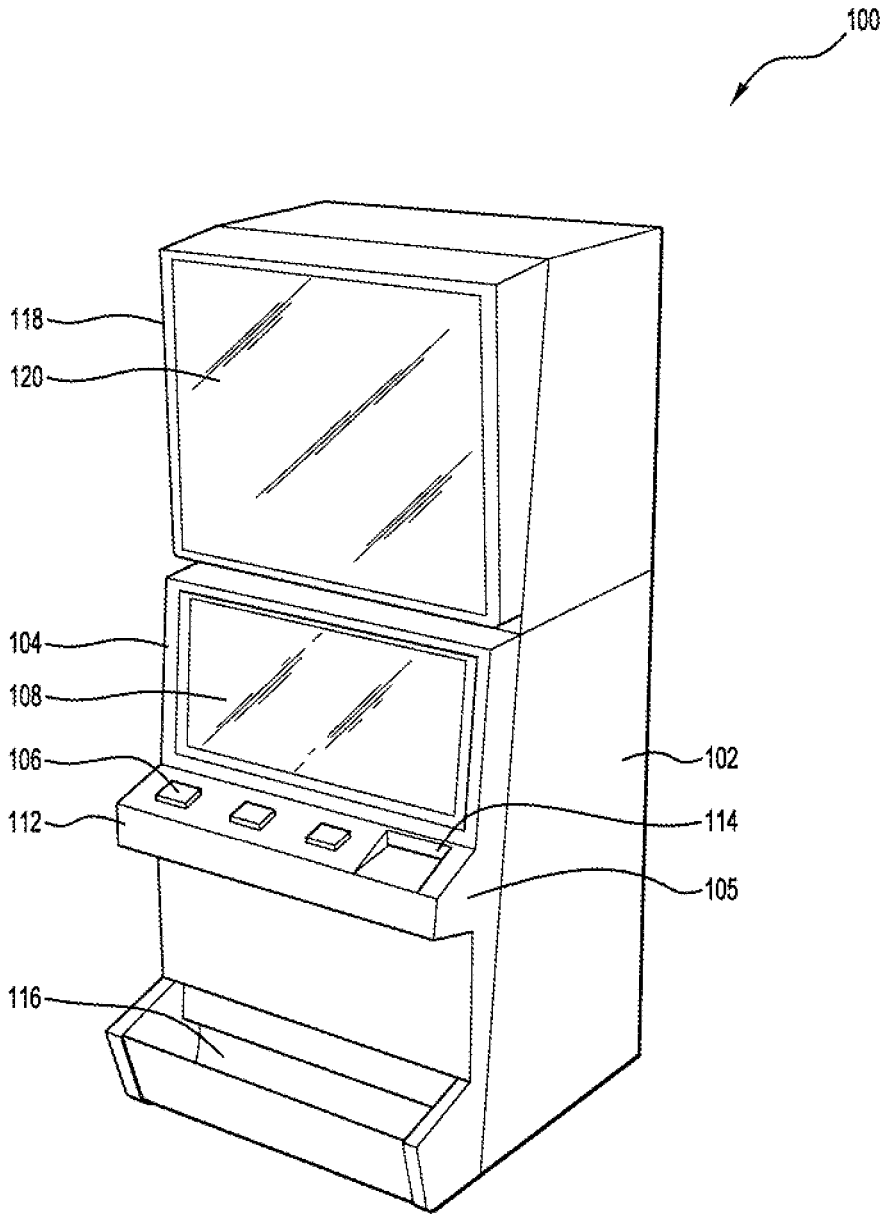
FIG. 1 shows a perspective view of a gaming machine.

Described embodiments generally relate to a gaming machine having a player selectable bonus feature and a method of using a gaming machine having a player selectable bonus feature.

The gaming system can take a number of different forms. In a first form, a stand-alone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in standalone gaming machine mode, "thick client" mode or "thin client" mode depending on the game being played, operating conditions, and so on. Other variations will be apparent to persons skilled in the art.

One or more of the method steps described in this disclosure may be implemented by executable instructions and parameters 232, 234 (See FIG. 2), stored in the memory 204, 206, 230 (See FIG. 2), that may form software embodiments of the system 100. These instructions 232, 234 that form the system 100 may be executed by the CPU 202 (See FIG. 2) or any other processor. Further, the processor 202, the memory 204, 206, 230, the instructions 232, 234 stored therein, or a combination thereof may serve as a means for performing one or more of the method steps described herein.

Figure 2:
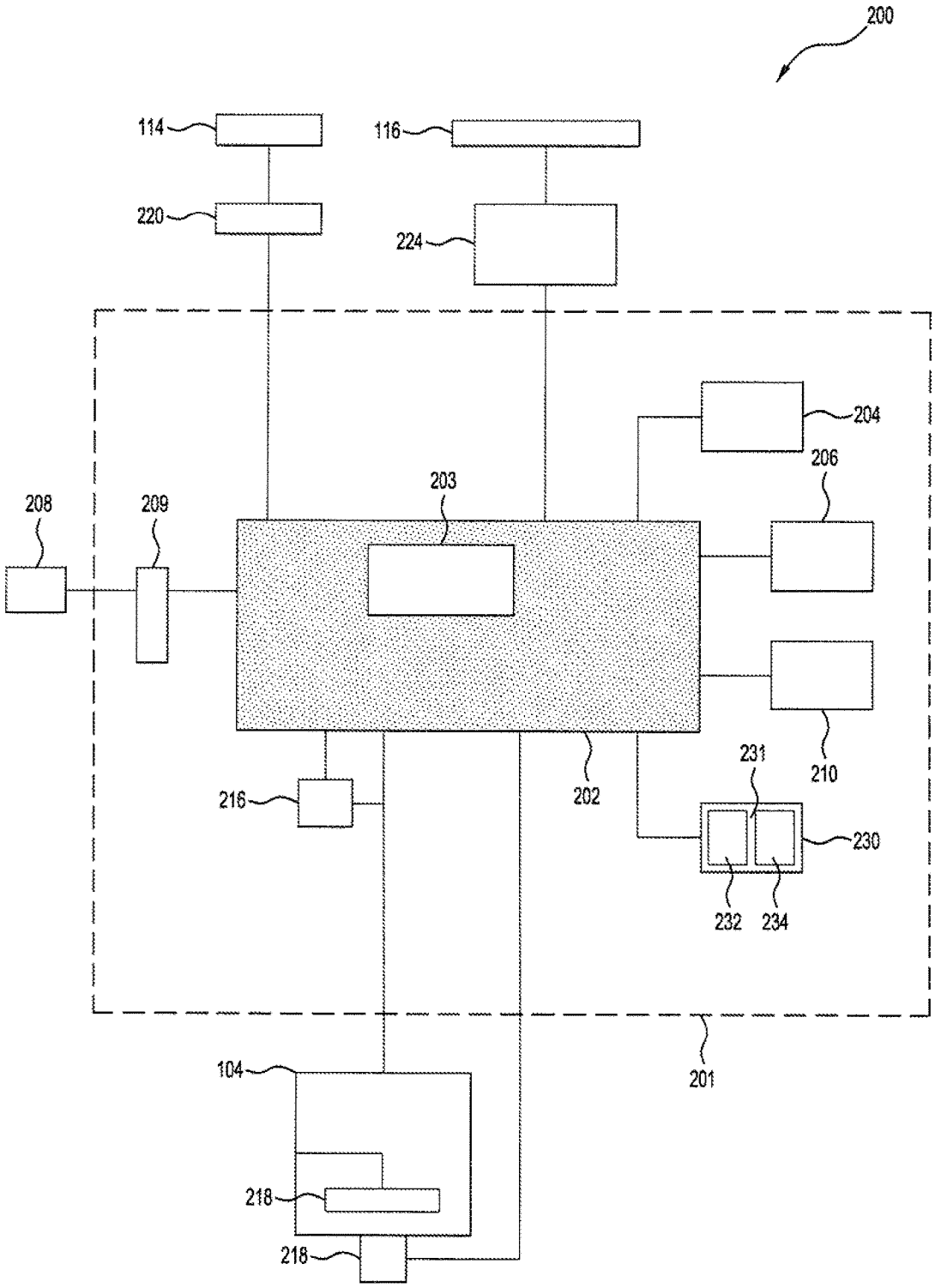
FIG. 2 shows a block diagram of a game logic circuit of the gaming machine illustrated in FIG. 1.

Irrespective of the form, the gaming system 100 has several core components. At the broadest level, the core components are a player interface in the form of a touch screen 108 as illustrated in FIG. 1 and a game controller 200 as illustrated in FIG. 2. The player interface is arranged to enable manual interaction between a player and the gaming system and for this purpose includes the input/output components required for the player to enter instructions and play the game.

Referring now to FIG. 1, reference numeral 100 generally designates a stand-alone gaming system including a game. Hereinafter, the stand-alone gaming system 100 will be referred to as a gaming machine.

The gaming machine 100 includes a console 102 which contains all or most components required to implement a game play whereby a player wins or loses a wager. Access to the components is by way of a hinged door 105. Moulded to the exterior of the console 102 is a display means in the form of at least one visual display unit 104 on which one or more games is played. The video display unit 104 may be implemented as a liquid crystal display, a plasma screen, as a cathode ray screen device or the like. Whilst the console 102 illustrated in FIG. 1 shows a single visual display unit 104, there can be more than one visual display unit on a typical machine. What is displayed on the visual display unit 104 will depend on what the intended goal of the unit is in relation to the player and any other potential participants in the gaming system.

The gaming machine includes a tactile input for a player to interact via touch with the gaming machine 100. In this example, the tactile input is in the form of a combination of pushbuttons 106 and a touch screen 108 for enabling a player to play one or more games. The touch screen is an electronic visual display that can detect the presence and location of a touch within the display area. The touch screen 108 is used during the game play between start of a game and the end of a game. A game is considered to have started once a wager is placed and considered complete once the wager has been lost or won. Certain functions of the pushbutton are: initiation of game play, credit output, gameplay selection, completion of gameplay etc. A midtrim 112 of the machine 100 houses the pushbuttons 106.

The tactile input may optionally or further include a joystick comprising of a stick that pivots on a base and reports its angle or direction to the device it is controlling. The tactile input may optionally or further include a trackpad/touchpad being a pointing device featuring a tactile sensor to translate the motion and position of a user's fingers to a relative position on screen.

It should be appreciated that tactile input may include any suitable device that enables the player to produce an input signal that is received by the processor. Tactile input in the form of pushbuttons 106 and/or regions on touch screen 108 may include a one bet button, a max bet button, or a repeat the bet button. With a one bet button for instance, the player places a bet by pushing the one bet button. The player may increase the bet by one credit each time the player pushes the bet one button.

The midtrim 112 also houses credit input device including a bill collector 114. The credit input device may further include a coin input chute, a card and/or ticket reader, a magnetic reading head for reading a magnetic stripe card, an electronic reader for a proximity card, a near field communications reader or any other form of electronic, wireless or contact that can input credit to the gaming machine.

A credit dispenser in the form of a coin tray 116 is mounted beneath the console 102 and is provided for cash payouts from the machine 100 to the player. A hopper device (not shown) is provided which dispenses coins, or tokens equal to the amount of credit currently on the machine, into the coin tray 116. Aside from the coin tray 116, the credit dispenser may also include a ticket dispenser for issuing a ticket dispensed by a printer which the user can redeem for cash, a note dispenser, a near field communications transmitter or means to enable remote credit transfer. It should be appreciated that any suitable payout mechanisms, such as funding to the player's electronically recordable identification card or smart card, may be implemented in accordance with the gaming machine disclosed herein.

The gaming machine 100 includes a top box 118 on which artwork 120 is carried in the form of electronic visual display units. The artwork 120 could also be made from physical materials such as paper, plastic banners or posters. The artwork 120 may have generic information related to the machine or gaming system or the artwork 120 be specifically made for a particular game to be played on the machine 100. Whilst the artwork 120 is shown as being carried on the top box 118 the art work 120 can also be positioned in or on the bottom panel of the door 105, or any other part of the gaming machine 100 visible to the player.

The gaming machine 100 further includes an auditory unit in the form of speakers (not shown) to provide auditory feedback to the player of the gaming machine 100.

Referring to FIG. 2 of the drawings, game logic circuitry 200 is illustrated. The game logic circuitry 200 includes a gaming controller 201 (otherwise referred to as a logic cage) designated by the dashed lines. As will be appreciated by those skilled in the gaming industry, the logic cage 201 includes a box-like mechanical structure that has slots to guide logic cards into the proper location for electronically plugging into a backplane mounted at the rear of the cage structure. The backplane has connectors for accepting mating connectors on the logic cards. The logic cage and associated cards form one of the basic components of the gaming machine 100 and is securely housed within the cabinet of the gaming machine 100.

Central to the logic cage is a central processing unit 202 such as a processor, a microcontroller-based platform, a suitable integrated circuit, or one or more application-specific integrated circuits (ASIC's). The processor 202 is in communication with or operable to access or to exchange signals with at an outcome evaluator 203, RAM 204, ROM 206, a non-volatile memory in the form of a compact flash 230, an audio output 208 via an audio control module 209, and a random number generator 210. The audio control module 209 has its own digital signal processor, analogue to digital converters, amplifiers and other circuitry necessary to broadcast the output from the speakers. RAM 204 may include non-volatile RAM (NVRAM), magnetic RAM (MRAM), ferroelectric RAM (FeRAM), and other forms as commonly understood in the gaming industry.

Compact flash memory 230 is physically secured within a slot in the logic cage 201. In one embodiment, the compact flash memory 230 is physically secured inside the logic cage within game logic circuitry 200 by a mechanical locking mechanism. Compact flash memory 230 is partitioned 231 into two parts. A first part comprises a game software module 232 and a second part comprises a metering information module 234.

The processor 202 runs executable code residing in game software module 232 of compact flash 230 that facilitates play of the game by a player through the display device and/or push buttons and touch sensors mounted in the screen of the display. Metering information module 234 contains the gaming machine parameters which include values that would usually be stored on a hard meter. The values in metering information module 234 are only ever incremented, and cannot be reset or decremented. The only way to alter the values stored is by running the executable code stored in game software module 232, which is executed by processor 202. The executable code further interacts with the credit dispenser 116 via a payout mechanism 224 and the auditory output 208. The game software module 232 contains the rules of the game, the sequence of gameplay, communicates with external systems, monitors peripheral equipment, maintain integrity of the software code, etc. The processor 202 continually checks for error conditions.

A program which implements the game logic circuitry 200 and the user interface is further run by the central processing unit 202. The processor 202 forms part of a controller 216 that drives the screen of the video display unit 104 and that receives input signals from sensors 218. The sensors 218 include sensors associated with the push buttons and touch sensors mounted in the screen of the video display unit 104. The controller 214 also receives input pulses from mechanisms 220 and 224 to determine whether or not a player has provided sufficient credit from either payment device 114 or payment device 116 to commence playing.

In one embodiment, a player may insert an identification card into a card reader (not shown) of the gaming machine 100. Such an identification card may be a smart card having a programmed microchip, a coded magnetic strip, or coded rewritable magnetic strip, wherein the programmed microchip or magnetic strips are coded with a player's identification, credit totals (or related data), and/or other relevant information. In another embodiment, a player may carry a portable device, such as a mobile phone, a radio frequency identification tag, or any other suitable wireless device, that communicates a player's identification, credit totals (or related data), and other relevant information to the gaming device.

Figure 3:
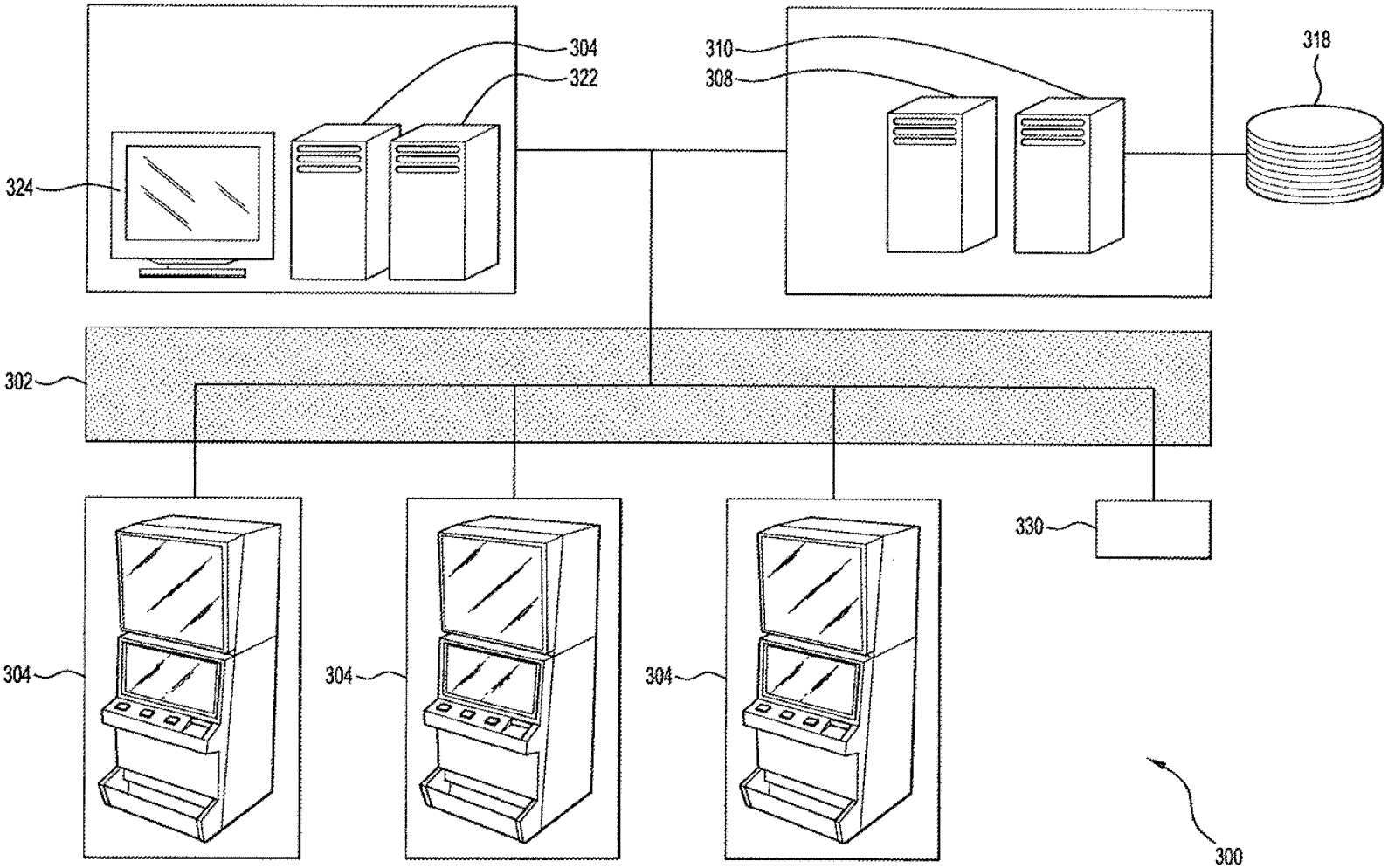
FIG. 3 shows a block diagram of functional components of a gaming system incorporating gaming machines illustrated in FIG. 1.

FIG. 3 shows a gaming system 300 in accordance with an alternative embodiment. The gaming system 300 includes a network 302, which for example may be an Ethernet network. The network 302 may also comprise a wide area network ("WAN"), the plain-old-telephone-system ("POTS), a local area network ("LAN"), a wireless LAN, the Internet, or any combination of these and other types of networks. Gaming machines 304 are connected to the network 302. The gaming machines 304 provide a player operable interface and may be the same as the gaming machines 100 shown in FIG. 1 or may have simplified functionality depending on the requirements for implementing game play.

In a thick client embodiment, game server 308 implements part of the game played by a player using a gaming machine 304 and the gaming machine 304 implements part of the game. With this embodiment, as both the game server 308 and the gaming device implement part of the game, they collectively provide a game controller. A database management server 310 may manage storage of game programs and associated data for downloading or access by the gaming devices 304 in a database 318.

In a thin client embodiment, game server 308 implements most or all of the game played by a player using a gaming machine 304 and the gaming machine 304 essentially provides only the player interface. With this embodiment, the game server 308 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components.

Servers are also typically provided to assist in the administration of the gaming network 300, including for example a gaming floor management server 320, and a licensing server 322 to monitor the use of licenses relating to particular games. An administrator terminal 324 is provided to allow an administrator to run the network 302 and the devices connected to the network.

The gaming system 300 may communicate with other gaming systems, other local networks, for example a corporate network, and/or a wide area network such as the Internet, for example through a firewall 330.

Persons skilled in the art will appreciate that in accordance with known techniques, functionality at the server side of the network may be distributed over a plurality of different computers. For example, elements may be run as a single "engine" on one server or a separate server may be provided. For example, the game server 308 could run a random generator engine. Alternatively, a separate random number generator server could be provided. Further, persons skilled in the art will appreciate that a plurality of game servers could be provided to run different games or a single game server may run a plurality of different games as required by the terminals.

Figure 4:
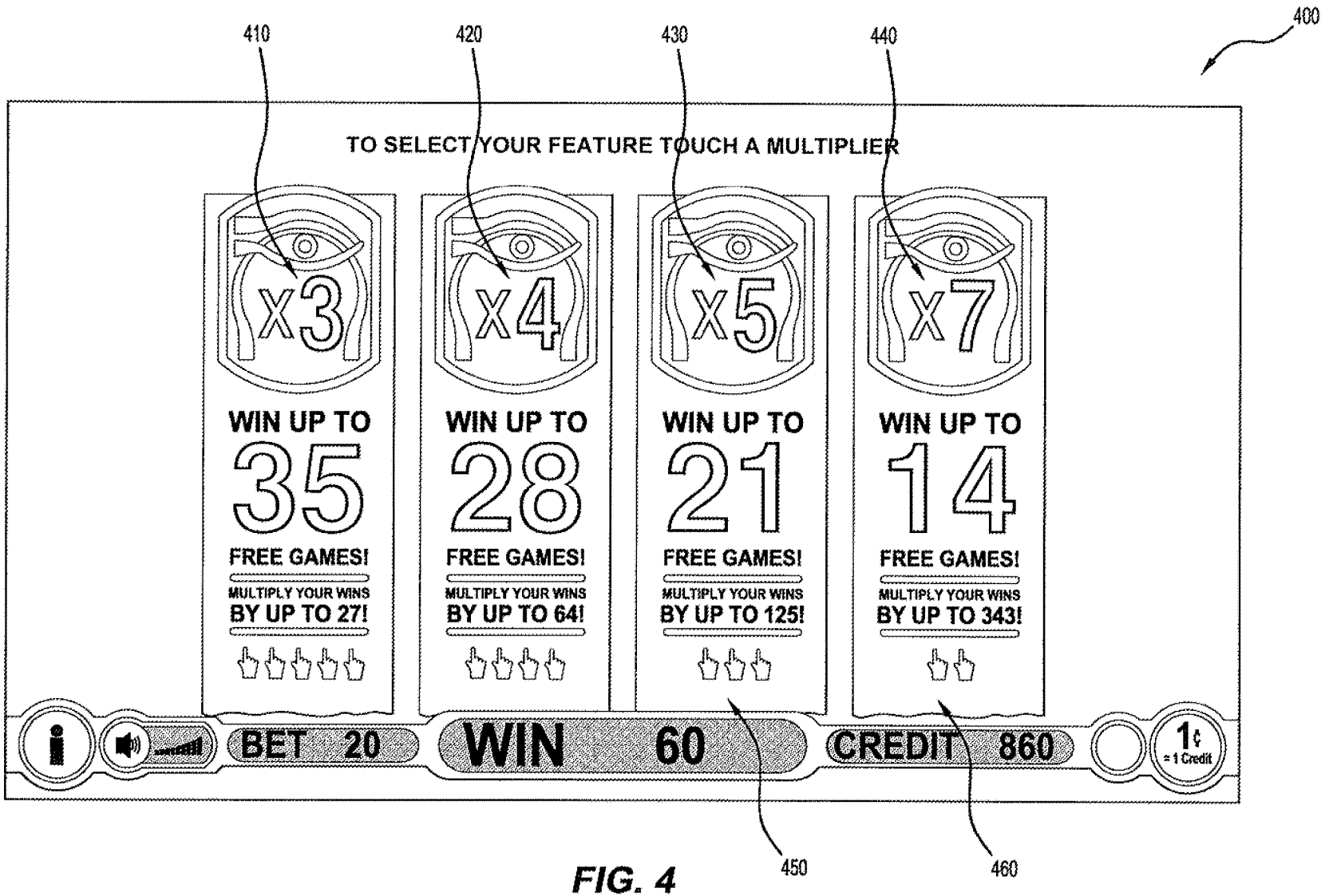
FIG. 4 shows a screen display of the first stage of the bonus selection which is displayed to a player prior to commencing play of a game on the gaming machine of FIG. 1.

FIG. 4 shows a screen display 400 displayed to the player prior to commencing play of a game on the gaming machine 100. The game in this example is a spinning reel game comprising a plurality of spinning reels. However in other non-limiting embodiments the game may be a card game, a game of dice, a ball game or a wheel game. Screen display 400 shows the first stage of the bonus selection. Four different bonus features are provided; a "3×" multiplier 410, a "4×" multiplier 420, a "5×" multiplier 430 and a "7×" multiplier 440. In this example, the player is able to choose a particular multiplier, for example the "×5" multiplier 430 and the chosen multiplier will be fixed for the entire bonus round. Associated with each multiplier is a range of all possible free games. As is illustrated, the "×5" multiplier 430 is associated with up to '21 free games' whereas the "×7" multiplier is associated with 'up to 14 free games'.

In addition to the choice of a bonus feature, the player is allocated a number of selections to use in the second stage of the bonus selection. This is effectively a crude adjustment. The player, having chosen the "×5" multiplier 430 is allocated three selections 450 as is indicated by the number of hands. In the event that the player chose the "×7" multiplier 440 the player would have been allocated two selections 460.

Figure 5:
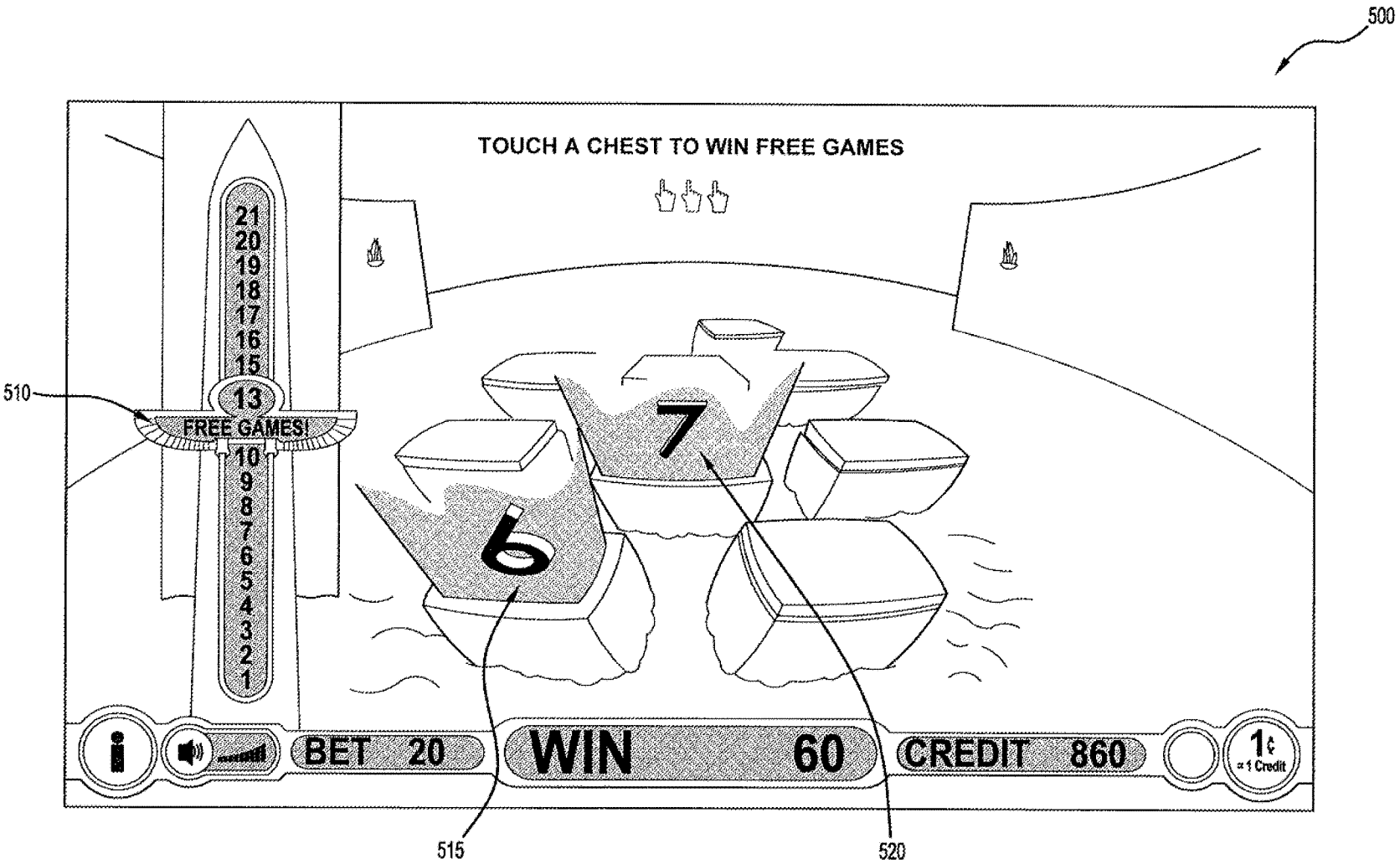
FIG. 5 shows a screen display of the second stage of the bonus selection which is displayed to the player on the gaming machine of FIG. 1.

In the second stage of the bonus selection, the player wins free games by using selections that he or she was allocated in the first stage. FIG. 5 shows a successive screen display 500 displayed to the player once the player has selected the "×5" multiplier. The sliding scale 510 on the left shows the maximum number of possible free games associated with the "×5" multiplier, being 21 free games. In the centre of the display 500 are a number of Egyptian chests, each chest containing a number of free games having a number between one and seven. This second stage of the bonus selection constitutes fine adjustment. In this particular example, the player was allocated three selections. As is illustrated, two of the selections have resulted in the player being awarded "6 free games" 515 and "7 free games" 520. Each time the player opens an unopened chest the sliding scale displays to the player the cumulative total of free games won. The outcome/result of each selection is random and the selection results are independent of each other. Therefore the result of the second selection is completely independent from the first selection, and the result of the third selection is completely independent from the previous first and second selections.

In addition, the outcome of each selection is not uniform within the range. The controller is configured to randomly allocate a number of bonus games not exceeding $MAX_{FG}/S_N$ to each of the player selectable items. So for instance having selected the "×5" multiplier, the maximum number of bonus games able to be allocated per selection is 7. The step of randomly allocating a number of bonus games to each of the player selectable items involves (i) determining a range of potential bonus games to be allocated, (for example from 4 free games to 7 free games) each potential bonus game being a chance event (for example "4 free games" is one chance event, "5 free games" is a second chance event etc), (ii) assigning a weight to each chance event (for example either $1/6^{th}$ of a chance for or $2/6^{th}$ of a chance, and (iii) calculating the outcome for the player selectable item using a formula that produces a weighted score accounting for each chance event based on its defined weighting.

Table 1 below shows an example of assigned weights. In the example of selecting the "×5" multiplier, each selection has $2/6^{th}$ of a chance to draw an outcome of 4 free games, $2/6^{th}$ of a chance to draw an outcome of 5 free games, $1/6^{th}$ of a chance to draw an outcome of 6 free games and $1/6^{th}$ of a chance to draw an outcome of 7 free games. Accordingly the average number of free games is a number determined by the odds assigned to each outcome. Generally, the average number of free games for each selection is any number between 4 and 7.

TABLE 1

| Potential Number of Free Games | Weight (3× multiplier) | Weight (4× multiplier) | Weight (5× multiplier) | Weight (7× multiplier) |
|---|---|---|---|---|
| 4 | 1 | 2 | 2 | 1 |
| 5 | 2 | 1 | 2 | 1 |
| 6 | 2 | 2 | 1 | 2 |
| 7 | 1 | 1 | 1 | 2 |
| Total | 6 | 6 | 6 | 6 |

Figure 6:
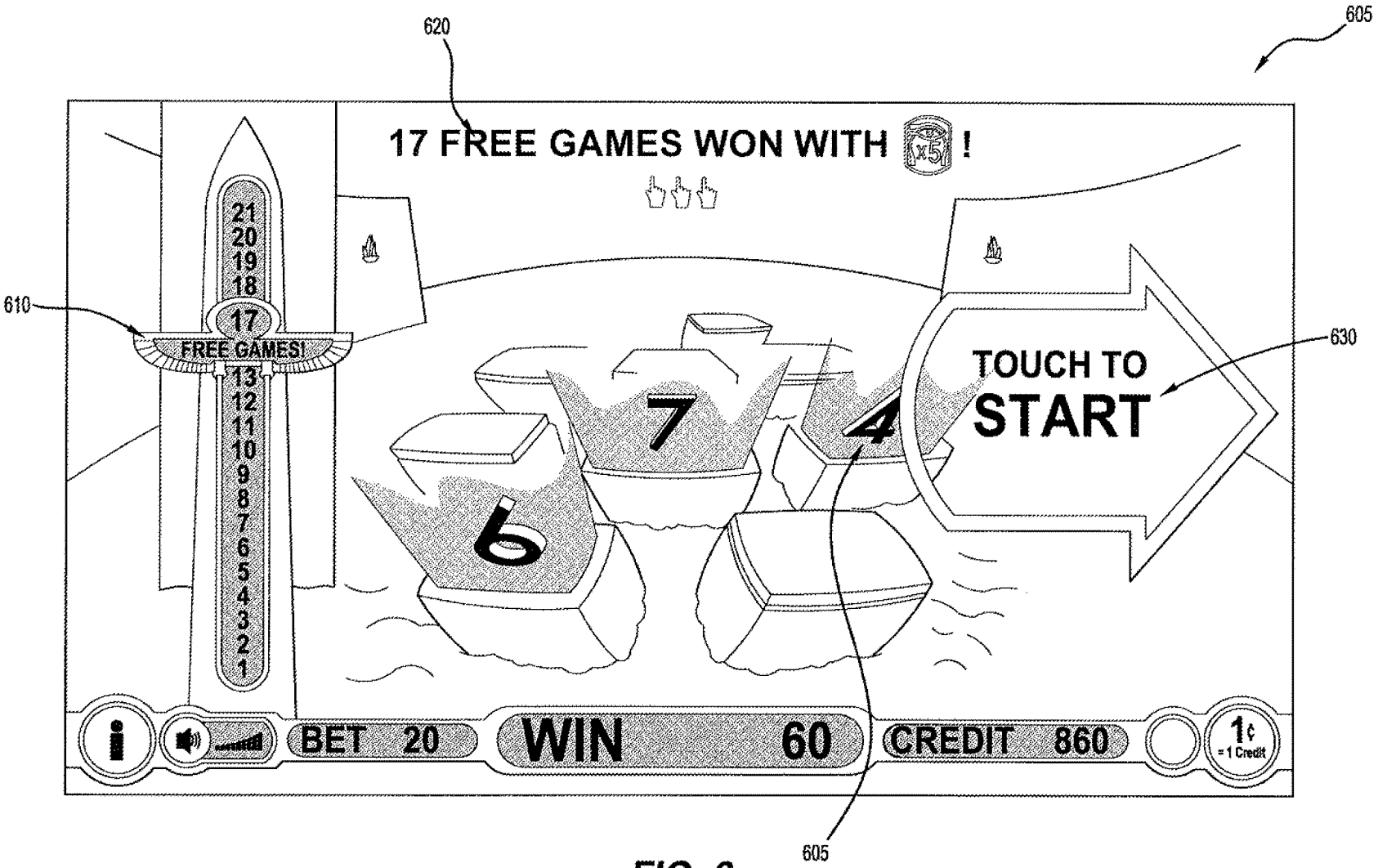
FIG. 6 shows a further screen display from the second stage of the bonus selection which is displayed to the player on the gaming machine of FIG. 1.

FIG. 6 shows a successive screen display 600 displayed once the player has applied their third and final selection. This third selection resulted in a further "4 free games" 605 which brings the total number of free games to 17 as is indicated on the sliding scale 610. Now that the player has used up all of their allocated selections the result "17 free games won with ×5!" is displayed 620 and play of the awarded bonus games is able to commence by the player touching the start area indicated on the screen 630.

Figure 7:
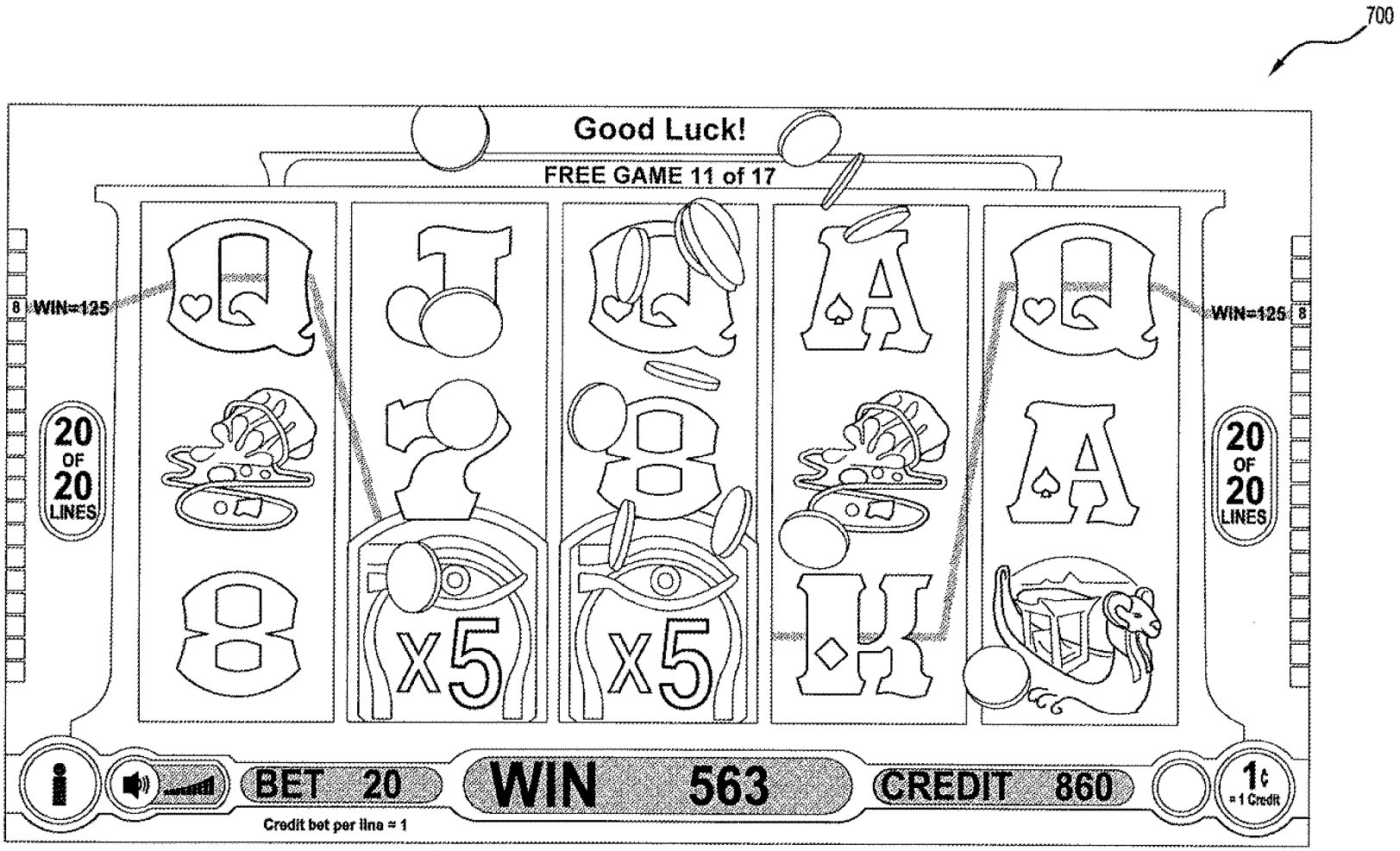
FIG. 7 shows a screen display of a bonus game played on the gaming machine of FIG. 1.

FIG. 7 shows a screen display 700 of the eleventh bonus game in the bonus round played on the gaming machine 100. During each of the seventeen bonus games in the bonus round, the bonus feature (the "×5" multiplier) selected by the player in the first stage of the bonus selection applies and can be seen during reel spin.

Figure 8:
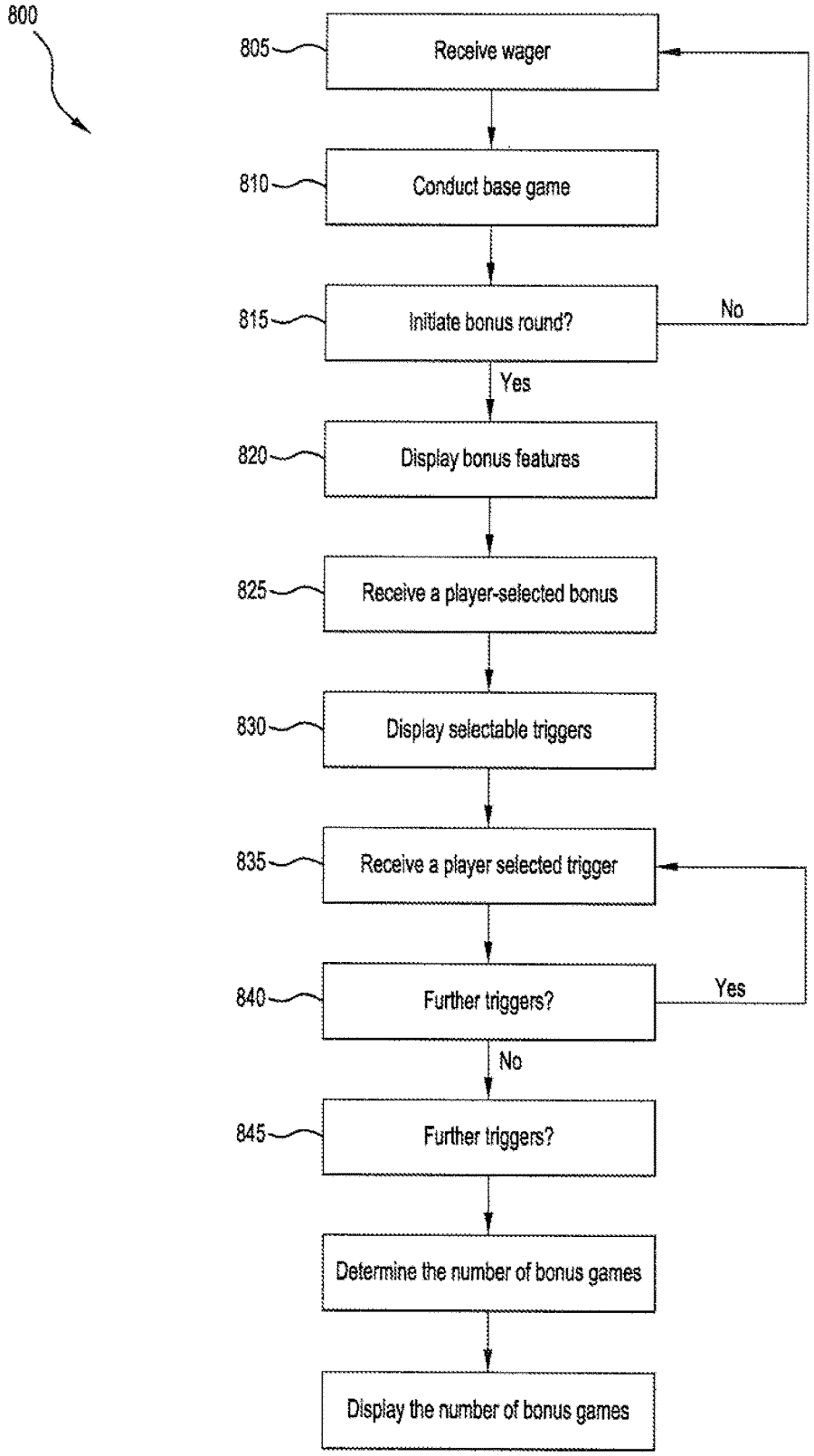
FIG. 8 shows a flow chart of an embodiment of a method according to the invention.

FIG. 8 shows a summary of the method 800 of the embodiment, which involves: initiating play by conducting a base game 810 in response to receipt of a wager 805 and determining 820 whether a bonus round is to be initiated. If a bonus round is not to be initiated, the game controller waits to receive a further wager 805. When a bonus round is initiated 815 the game controller displays 820 on the visual display interface a range of bonus features. Each bonus feature is linked to a maximum number of bonus games ($MAX_{FG}$) and a predetermined number of selections ($S_N$) and this information is made available to the player via the visual display interface. The game controller, having received a player-selected bonus feature 825 then displays on the visual display interface a number of player selectable items 830, each item representative of a number of bonus games not exceeding $MAX_{FG}/S_N$. The actual number of bonus games associated with each item is not known to the player until after the player selects an item. The game controller then receives a first player selected item 835 and the game controller is configured to randomly allocate a number of bonus games not exceeding $MAX_{FG}/S_N$ to each of the player selectable items. The game controller (i) determines a range of potential bonus games to be allocated, each potential bonus game being a chance event, (ii) assigns a weight to each chance event, and (iii) calculates the outcome for the player selectable item using a formula that produces a weighted score accounting for each chance event based on its defined weighting. It should be appreciated that this is only one way to achieve the number of bonus games such that the return to player is equalized. Other known means will be appreciated by those skilled in the art.

The outcome of the number of bonus games associated with that item is then displayed on the visual display interface. If the number of player selected items is not equal to $S_N$ 840, the process repeats until the number of player selected items equal to $S_N$ 845. The game controller then determines the number of bonus games from the player selected items 850 and the result is displayed to the player via the visual display interface 855.

Embodiments herein described are advantageous over prior art gaming machines in that the bonus feature is fixed for each bonus game in the bonus round. Equal return to player is then able to be achieved by randomizing the number of awarded free games.

Furthermore, because the selected bonus feature, for example the multiplier, is fixed for each individual spin of the reel in the bonus round, the visual effect of the multiplier is substantially present, throughout the bonus round. This is a significant improvement over prior art gaming machines.

Embodiments herein described also provide an extra excitement factor from the ability to win up to a maximum number of free games as part of the volatility selection sequence, in other words, applying a game within a game.

It should be appreciated that the average number of bonus games will vary according to the multiplier selected and the costs involved (a lower multiplier will be less expensive that a higher multiplier). In an example, and so that a return to player percentage is at least equal to a predetermined return to player, an average number of bonus games may be set at 10.5 bonus games with a "×7" multiplier, 17.4 bonus games with a "×5" multiplier, 22.7 bonus games with a "×4" multiplier and 30.5 bonus games with a "×3" multiplier. Therefore, if the player selects the "×7" multiplier the gaming machine needs to award, on average, 10.5 bonus games.

Other means of effecting the second stage of the bonus selection may be incorporated. For instance the controller may be configured to randomly select one of a plurality of predetermined pathways. In such an example, the predetermined return to player may be set at 27.5 average free games. Stored to memory may be a plurality of predetermined pathways, for instance for five selections a first pathway may yield "4 bonus games", "5 bonus games", "7 bonus games", "4 bonus games" and "6 bonus games" whereas a second pathway may yield "7 bonus games", "7 bonus games", "5 bonus games", "5 bonus games" and "5 bonus games". As should be appreciated, regardless of what items the player selects, if the controller randomly selects the first pathway the player will receive a total of "26 bonus games" and if the controller randomly selects the second pathway, the player will receive a total of "29 bonus games".

Optionally, the controller can be configured to select the number of bonus games according to a weight table that averages 10.5 games immediately and without further input from the player.

An advantage of immediately awarding bonus games is that the ranges are more flexible. In order to award an average of 30.5 bonus games for a "×3" multiplier, it is possible to use a weight table from 20 to 50 range rather than for instance 20 to 35.

It will be appreciated by persons skilled in the art that numerous variations and/or modifications may be made to the above-described embodiments, without departing from the broad general scope of the present disclosure. The present embodiments are, therefore, to be considered in all respects as illustrative and not restrictive.

While the foregoing description has been provided by way of example of the preferred embodiments of the present invention as presently contemplated, which utilise gaming machines of the type found in casinos, those skilled in the relevant arts will appreciate that embodiments of the present invention also may have application to internet gaming and/or have application to gaming over a telecommunications network, where mobile handsets are used to display game outcomes and receive player inputs. Such mobile devices include smart phones, notebooks, tablets, iPads and laptop computers. For instance free mobile device games may be offered for download and play on a players personal mobile device as a bonus game play. In such an embodiment the gaming machine may comprise a power interface to enable interaction between the respective devices and/or a communication or wireless interface to enable data transfer. During game play, the gaming machine may be configured to send information to the player's personal mobile device Further embodiments may enable a player to upload the outcome of a game or bonus game to a social media site(s), post tournament scores etc.

Certain steps in the processes or process flows described in this disclosure naturally precede others for the invention to function as described. However, the invention is not limited to the order of the steps described if such order or sequence does not alter the functionality of the invention. That is, it is recognized that some steps may performed before, after, or parallel (substantially simultaneously with) other steps without departing from the scope and spirit of the invention. In some instances, certain steps may be omitted or not performed without departing from the invention. Further, words such as "thereafter", "then", "next", etc. are not intended to limit the order of the steps. These words are simply used to guide the reader through the description of the exemplary method.

Additionally, one of ordinary skill in programming is able to write computer code or identify appropriate hardware and/or circuits to implement the disclosed invention without difficulty based on the flow charts and associated description in this specification, for example.

Therefore, disclosure of a particular set of program code instructions or detailed hardware devices is not considered necessary for an adequate understanding of how to make and use the invention. The inventive functionality of the claimed computer implemented processes is explained in more detail in the above description and in conjunction with the figures which may illustrate various process flows.

In one or more exemplary aspects, the functions described may be implemented in hardware, software, firmware, or any combination thereof. If implemented in software, the functions may be stored on or transmitted as one or more instructions or code on a computer-readable medium. Computer-readable media include both computer storage media and communication media including any medium that facilitates transfer of a computer program from one place to another.

A storage media may be any available media that may be accessed by a computer. By way of example, and not limitation, such computer-readable media may comprise RAM, ROM, EEPROM, CD-ROM or other optical disk storage, magnetic disk storage or other magnetic storage devices, or any other medium that may be used to carry or store desired program code in the form of instructions or data structures and that may be accessed by a computer.

Also, any connection is properly termed a computer-readable medium. For example, if the software is transmitted from a website, server, or other remote source using a coaxial cable, fiber optic cable, twisted pair, digital subscriber line ("DSL"), or wireless technologies such as infrared, radio, and microwave, then the coaxial cable, fiber optic cable, twisted pair, DSL, or wireless technologies such as infrared, radio, and microwave are included in the definition of medium.

Disk and disc, as used herein, includes compact disc ("CD"), laser disc, optical disc, digital versatile disc ("DVD"), floppy disk and blu-ray disc where disks usually reproduce data magnetically, while discs reproduce data optically with lasers. Combinations of the above should also be included within the scope of computer-readable media.

Although selected aspects have been illustrated and described in detail, it will be understood that various substitutions and alterations may be made therein without departing from the spirit and scope of the present invention.

The invention claimed is:

1. A gaming machine with bonus round, the gaming machine comprising:

a player interface;

a credit input device;

memory storing data corresponding to a plurality of bonus game tables, each bonus game table associated with a bonus feature and each bonus game table presenting a range of data values each corresponding to a different number of bonus games; and an electronic controller arranged to control play of a game on the player interface in response to receiving input via the credit input device; wherein prior to commencement of the bonus round, the electronic controller is arranged to:

display on the player interface a range of bonus features; and in response to receiving via the player interface a player-selected bonus feature, determine a number of bonus games to be awarded to the player in the bonus round;

wherein the determination of the number of bonus games is randomized and is equalized dependent on the bonus feature selected by the player so that a return to player percentage is at least equal to a predetermined return to player; and wherein the gaming machine is further arranged such that the player selected bonus feature applies to each and every awarded bonus game in the bonus round.

2. A gaming machine according to claim 1, wherein the controller is configured to select from the memory, the bonus game table corresponding to the player selected feature and to further select a data value from within the selected table on a weighted random basis.

3. A gaming machine according to claim 1, wherein the selection of the data value from within the selected table is weighted such that, statistically, at least one data set is more likely to be selected than another.

4. A gaming machine according to claim 3, wherein, the data sets are weighted according to a standard, bell curve, statistical, or a normal distribution curve.

5. A gaming machine according to claim 1, wherein each bonus feature is linked to a maximum number of bonus games ($MAX_{FG}$) and a predetermined number of selections ($S_N$), wherein each selection is associated with a range of possible awarded bonus games.

6. A gaming machine according to claim 5, wherein the number of bonus games associated with each selection is randomized and equalized so that a return to player percentage is at least equal to a predetermined return to player.

7. A gaming machine according to claim 6, wherein the controller is further arranged to randomly allocate a number of bonus games not exceeding $MAX_{FG}/S_N$ to each of the player selectable items which comprises:

determining a range of potential bonus games to be allocated, each potential bonus game being a chance event;

assigning a weight to each chance event; and calculating the outcome for the player selectable item using a formula that produces a weighted score accounting for each chance event based on its defined weighting.

8. A gaming machine according to claim 1, wherein the gaming machine further comprises a memory storing a plurality of predetermined pathways, wherein each pathway comprises a set of bonus games, the size of the set is equal to $S_N$, and wherein the average of each of the predetermined pathways is equalized so that a return to player percentage is at least equal to a predetermined return to player.

9. A gaming machine according to claim 1, wherein the controller is configured to randomly select one of the pluralities of predetermined pathways.

10. A gaming machine according to claim 9, wherein the range of bonus features comprises a range of multipliers.

11. A gaming machine according to claim 1, wherein the controller is arranged to display on separate screens of the player interface, a range of bonus features and a plurality of player selectable items.

12. A gaming machine according to claim 1, wherein the controller is arranged to display on the same screen of the player interface, a range of bonus features and subsequently a plurality of player selectable items.

13. A gaming machine according to claim 1, wherein the controller is arranged such that weights assigned to chance events are dependent on the selected multiplier.

14. A method of gaming using a gaming machine having a controller and a credit input device, the method comprising, prior to initiating play of a bonus round and in response to receiving input via the credit input device:

storing a plurality of bonus game tables, each bonus game table associated with a bonus feature and each bonus game table presenting a range of data values each corresponding to a different number of bonus games displaying on a player interface a range of bonus features;

receiving via the player interface a player-selected bonus feature; and determining a number of bonus games to be awarded in the bonus round; wherein the determination of the number of bonus games to be awarded is randomized and is equalized dependent on the bonus feature selected by the player so that a return to player percentage is at least equal to a predetermined return to player; and wherein the player-selected bonus feature applies to each and every awarded bonus game in the bonus round.

15. A method of gaming using a gaming machine according to claim 14, the method further comprising selecting a bonus game table corresponding to the player selected feature; and selecting a data value from within the selected table on a weighted random basis.

16. A method of gaming using a gaming machine according to claim 14, wherein each bonus feature is linked to a maximum number of bonus games ($MAX_{FG}$) and a predetermined number of selections ($S_N$); and wherein each selection is associated with a range of possible awarded bonus games.

17. A method of gaming using a gaming machine according to claim 16, wherein the number of bonus games associated with each selection is randomized and equalized according to a predetermined return to player.

18. A method of gaming using a gaming machine according to claim 17, the method further comprising randomly allocating a number of bonus games not exceeding $MAX_{FG}/S_N$ to each of the player selectable items which may comprise: determining a range of potential bonus games to be allocated, each potential bonus game being a chance event;

assigning a weight to each chance event; and calculating the outcome for the player selectable item using a formula that produces a weighted score accounting for each chance event based on its defined weighting.

* * * * *